US012391898B2

(12) United States Patent
Hattori et al.

(10) Patent No.: US 12,391,898 B2
(45) **Date of Patent: *Aug. 19, 2025**

(54) FRICTION MODIFIER SYSTEM

(71) Applicants: CHEVRON JAPAN LIMITED, Tokyo (JP); CHEVRON ORONITE COMPANY LLC, San Ramon, CA (US)

(72) Inventors: Taiki Hattori, Shizuoka (JP); Koichi Kubo, Yokohama (JP); William Raymond Ruhe, Jr., Solano, CA (US)

(73) Assignees: CHEVRON JAPAN LIMITED, Tokyo (JP); CHEVRON ORONITE COMPANY LLC, San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/028,859

(22) PCT Filed: Oct. 5, 2021

(86) PCT No.: PCT/IB2021/059104

§ 371 (c)(1),
(2) Date: Mar. 28, 2023

(87) PCT Pub. No.: WO2022/074547

PCT Pub. Date: Apr. 14, 2022

(65) Prior Publication Data

US 2023/0287291 A1 Sep. 14, 2023

Related U.S. Application Data

(60) Provisional application No. 63/087,617, filed on Oct. 5, 2020.

(51) Int. Cl.

| | |
|---|---|
| ***C10M 169/00*** | (2006.01) |
| ***C10M 133/44*** | (2006.01) |
| ***C10M 135/18*** | (2006.01) |
| ***C10M 141/08*** | (2006.01) |
| ***C10M 169/04*** | (2006.01) |
| *C10N 40/25* | (2006.01) |

(52) U.S. Cl.

CPC ..... *C10M 169/04* (2013.01); *C10M 133/44* (2013.01); *C10M 135/18* (2013.01); *C10M 141/08* (2013.01); *C10M 2203/003* (2013.01); *C10M 2215/30* (2013.01); *C10M 2219/068* (2013.01); *C10N 2040/25* (2013.01)

(58) Field of Classification Search

CPC ..... C10M 169/04; C10M 133/44; C10M 135/18; C10M 141/08; C10M 2203/003; C10M 2215/30; C10M 2219/068; C10M 2207/022; C10M 2207/026; C10M 2207/10; C10M 2207/28; C10M 2207/289; C10M 2209/084; C10M 2215/02; C10M 2215/04; C10M 2215/08; C10M 141/12; C10M 2215/086; C10M 2215/22; C10M 2215/221; C10M 2215/28; C10M 2223/045; C10N 2040/25; C10N 2010/04; C10N 2030/06

See application file for complete search history.

(56) References Cited

U.S. PATENT DOCUMENTS

| | | | |
|---|---|---|---|
| 3,024,195 | A | 3/1962 | Drummond |
| 3,172,892 | A | 3/1965 | Le Suer |
| 3,200,076 | A | 8/1965 | Anderson et al. |
| 3,219,666 | A | 11/1965 | Norman |

(Continued)

FOREIGN PATENT DOCUMENTS

| | | |
|---|---|---|
| CN | 102057023 B | 5/2016 |
| EP | 1508610 | 2/2005 |

(Continued)

OTHER PUBLICATIONS

Zagidullin, R.N., et al; "Development of Procedures for the Manufacturer of New Ashless Polymer Additives Derived from Imido Derivatives of Succinic Acid"; Chemistry and Technology of Fuels and Oils, vol. 53, No. 4, pp. 488-493 (Year: 2017).*

Zagidullin, R.N., et al; "Development of Procedures for the Manufacturer of New Ashless Polymer Additives Derived from Imido Derivatives of Succinic Acid"; (2017), Chemistry and Technology of Fuels and Oils, vol. 53, No. 4, pp. 488-493.

(Continued)

*Primary Examiner* — Taiwo Oladapo

(57) ABSTRACT

This disclosure describes a lubricant additive. The additive is a friction modifier that includes a molybdenum containing compound and a tertiary amine-containing composition having the following structure:

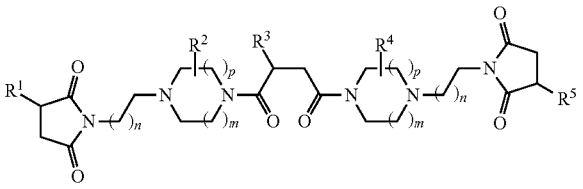

wherein each $R^1$ and $R^5$ is independently a linear or branched-chain monovalent hydrocarbyl group having one to about twenty carbon atoms, wherein each $R^2$, $R^3$, and $R^4$ is independently a hydrogen, a linear or branched-chain monovalent hydrocarbyl group having one to about twenty carbon atoms, each m is independently from 0 and 4, each p is independently from 0 and 4, for each cyclic moiety m+p is from 2 and 4, and each n is independently from 1 and 6.

20 Claims, No Drawings

(56) References Cited

U.S. PATENT DOCUMENTS

| | | | | |
|---|---|---|---|---|
| 3,272,746 | A | | 9/1966 | Suer |
| 3,356,702 | A | | 12/1967 | Farmer |
| 4,098,705 | A | | 7/1978 | Sakurai |
| 4,259,194 | A | | 3/1981 | deVries |
| 4,259,195 | A | | 3/1981 | King |
| 4,265,773 | A | | 5/1981 | deVries |
| 4,265,843 | A | | 5/1981 | Dias |
| 4,283,295 | A | | 8/1981 | deVries |
| 4,285,822 | A | | 8/1981 | deVries |
| 4,426,306 | A | * | 1/1984 | Lee ..... C10M 133/40 508/261 |
| 4,727,387 | A | | 2/1988 | Israely |
| 4,889,647 | A | | 12/1989 | Rowan |
| 5,171,466 | A | | 12/1992 | Korosec |
| 5,631,213 | A | | 5/1997 | Tanaka |
| 5,650,381 | A | | 7/1997 | Gatto |
| 5,888,945 | A | | 3/1999 | Stiefel |
| 6,010,987 | A | | 1/2000 | Stiefel |
| 6,174,842 | B1 | | 1/2001 | Gatto |
| RE37,363 | E | | 9/2001 | Gatto |
| 6,806,241 | B2 | | 10/2004 | Karol |
| RE38,929 | E | | 1/2006 | Gatto |
| 7,091,306 | B2 | | 8/2006 | Heddadj |
| RE40,595 | E | | 12/2008 | Gatto |
| 8,076,275 | B2 | | 12/2011 | Ruhe, Jr. |
| 8,598,100 | B2 | | 12/2013 | Koshima |
| 2002/0119895 | A1 | | 8/2002 | Cook |
| 2006/0160709 | A1 | | 7/2006 | Koshima et al. |
| 2018/0034635 | A1 | | 2/2018 | Zhang |
| 2019/0249105 | A1 | | 8/2019 | Delbridge |

FOREIGN PATENT DOCUMENTS

| | | | |
|---|---|---|---|
| JP | S49-067905 | | 7/1974 |
| JP | 2004043781 | A | 2/2004 |
| JP | 2009149890 | A | 7/2009 |
| WO | 03102117 | W | 12/2003 |

OTHER PUBLICATIONS

International Search Report, issued on Dec. 20, 2021, during the prosecution of International Application No. PCT/IB2021/059104.

Written Opinion of the International Searching Authority, issued on Dec. 20, 2021, during the prosecution of International Application No. PCT/IB2021/059104.

* cited by examiner

FRICTION MODIFIER SYSTEM

TECHNICAL FIELD

This disclosure relates to lubricating oil additives and lubricating oil compositions containing the same. More specifically, this disclosure describes friction modifier compositions that can improve fuel efficiency.

BACKGROUND

To reduce energy loss due to friction, lubricant additives such as friction modifiers, anti-wear agents, and antioxidants (the latter of which tend to lengthen the effect of the afore mentioned additives) may be blended into engine oil.

Furthermore, in order to reduce hydrodynamic friction in piston/cylinder of an engine, the viscosity of engine oils has been lowered. This has increased the importance of friction modifiers to offset the new boundary layer regime. Thus, the interaction of oil viscosity with various friction modifiers has been closely studied in an effort to improve fuel economy.

SUMMARY

In one aspect, there is provided a lubricating oil composition comprising: a) major amount of a base oil; and b) minor amount of a synergistic friction modifier composition comprising: i) a molybdenum containing compound; and ii) a tertiary amine-containing compound having the following structure:

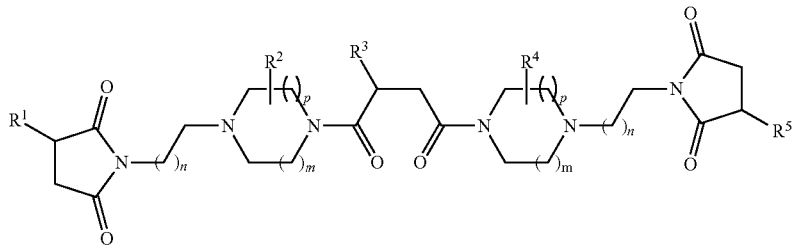

wherein each $R^1$ and $R^5$ is independently a linear or branched-chain monovalent hydrocarbyl group having one to about twenty carbon atoms, wherein each $R^2$, $R^3$, and $R^4$ is independently a hydrogen, a linear or branched-chain monovalent hydrocarbyl group having one to about twenty carbon atoms, each m is independently from 0 to 4, each p is independently from 0 to 4, for each cyclic moiety m+p is from 2 to 4, and each n is independently from 1 and 6.

The number of carbon atoms in the hydrocarbyl groups can have a big impact the oil solubility of the molecule. Therefore, the number of carbon atoms in the hydrocarbyl groups should be of sufficient number to allow the friction modifier to be oil soluble.

In another aspect, there is provided a method of modifying friction comprising lubricating an engine with a lubricating oil comprising: a) major amount of a base oil; and b) minor amount of a synergistic friction modifier composition comprising: i) a molybdenum containing compound; and ii) a tertiary amine-containing compound having the following structure:

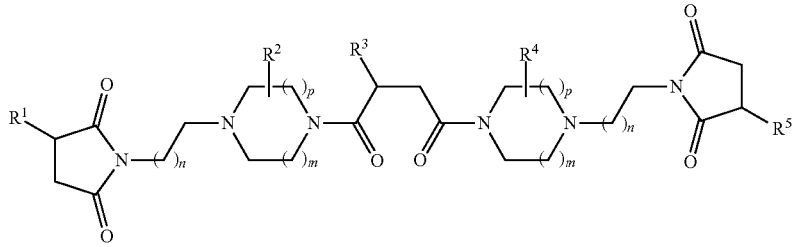

wherein each $R^1$ and $R^5$ is independently a linear or branched-chain monovalent hydrocarbyl group having one to about twenty carbon atoms, wherein each $R^2$, $R^3$, and $R^4$ is independently a hydrogen, a linear or branched-chain monovalent hydrocarbyl group having one to about twenty carbon atoms, each m is independently from 0 to 4, each p is independently from 0 to 4, for each cyclic moiety m+p is from 2 to 4, and each n is independently from 1 to 6.

In yet another aspect, there is provided a lubricating oil composition comprising: a) major amount of a base oil; b) a molybdenum containing compound; and c) product of a reaction comprising: i) a hydrocarbyl-substituted succinic anhydride represented by the following structure:

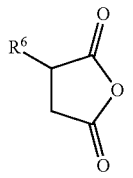

wherein $R^6$ is a linear or branched-chain monovalent hydrocarbyl group having one to about twenty carbon atoms; and ii) a cyclic polyamine represented by the following structure:

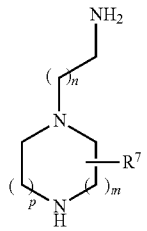

wherein $R^7$ is hydrogen, or a linear or branched-chain monovalent hydrocarbyl group having one to about twenty carbon atoms, m is from 0 to 4, p is from 0 to 4, m+p is from 2 to 4, and n is from 1 to 6; and wherein the hydrocarbyl-substituted succinic anhydride to cyclic polyamine ratio is from about 1.5:1 to about 1.6:1.

DETAILED DESCRIPTION

Definitions

The term "hydrocarbyl" refers to a chemical group or moiety derived from hydrocarbons including saturated and unsaturated hydrocarbons. Examples of hydrocarbyl groups include alkenyl, alkyl, polyalkenyl, polyalkyl, phenyl, and the like.

The terms 'oil-soluble' or 'oil-dispersible' as used herein do not necessarily indicate that the compounds or additives are soluble, dissolvable, miscible or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein.

The present invention relates to an additive composition that can be utilized as a friction modifier in lubricating oil. The friction modifier of the present invention includes at least two synergistic components. The first component includes product(s) of a reaction involving a hydrocarbyl-substituted succinic anhydride and a cyclic polyamine. The product is a tertiary amine-containing compound. The second component is a molybdenum containing compound.

Tertiary Amine-Containing Compound

The first component of the friction modifier composition may be synthesized by any known compatible method such as those described in, for example, U.S. Patent Publication No. 20180034635 and U.S. Pat. No. 7,091,306, which are hereby incorporated by reference.

The reaction may proceed under various conditions. Generally, the hydrocarbyl-substituted succinic anhydride is reacted with the cyclic polyamine at a temperature of about 130° C. to 220° C. (e.g., 140° C. to 200° C., 145° C. to 175° C., etc.). More preferably, the temperature may range from about 160° C. to 215° C. In general, the imidation step may be carried out at lower temperatures (e.g., 150° C. to 170° C.) while higher temperatures (e.g., 200° C. to 220° C.) may be necessary to complete the amidation step.

The reaction can be carried out under an inert atmosphere, such as nitrogen or argon. Generally, a suitable molar charge of hydrocarbyl-substituted succinic anhydride to cyclic polyamine is from about 1.4:1 to about 1.7:1, more preferably from about 1.5:1 to about 1.6:1. In some embodiments, it may be desirable to have a charge mole ratio (CMR) of the hydrocarbyl-substituted succinic anhydride to the cyclic polyamine to be about 1.55:1 or slightly higher in order to react with any unreacted secondary amines. It is believed that secondary amines are more aggressive against seals. The charge mole ratio is important as too much hydrocarbyl-substituted succinic anhydride can result in mono amide/acid structure while too little can result in mono succinimide products containing secondary amines. In some embodiments, the reaction may proceed with a mixture of hydrocarbyl-substituted succinic anhydrides having different hydrocarbyl groups.

In some embodiments, the reaction may proceed in multiple steps, wherein the total CMR of hydrocarbyl-substituted succinic anhydride to cyclic polyamine or cyclic polyamine product is from about 1.4:1 to about 1.7:1, more preferably from about 1.5:1 to about 1.6:1. For example, the first step may involve the reaction between the hydrocarbyl-substituted succinic anhydride and cyclic polyamine in a 1:1 charge mole ratio to generate the imide structure. In the second step, the imide structure is reacted with hydrocarbyl-substituted succinic anhydride at about 0.5 charge mole ratio (succinic anhydride to imide product). The total CMR of the two steps is 1.5:1. The hydrocarbyl-substituted succinic anhydride in the first step and hydrocarbyl-substituted succinic anhydride in the second step may be the same or may differ in the hydrocarbyl groups.

According to an embodiment, the hydrocarbyl-substituted succinic anhydride is given by Structure I:

Structure I

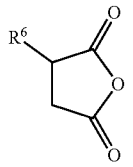

wherein $R^6$ is a linear or branched-chain monovalent hydrocarbyl group having one to about twenty carbon atoms, such as from ten to twenty carbon atoms, twelve to twenty carbon atoms, and fourteen to twenty carbon atoms. In some embodiments, the average number of carbons is about 14 or higher. $R^6$ may be cyclic or acylic. In some embodiments, $R^6$ is saturated. In other embodiments, $R^6$ is unsaturated.

The exact structure of the hydrocarbyl group may depend on a number of factors. Solubility in oil is an important consideration. In general, longer hydrocarbyl groups have greater solubility in oil.

Hydrocarbyl-substituted succinic anhydrides are commercially readily available. For example, alkenyl succinic anhydrides are widely used in paper sizing. Conversely, hydrocarbyl-substituted succinic anhydrides of the present invention may be synthesized by well-established methods. One conventional synthesis involves reacting maleic anhydride with an olefin at elevated temperatures (~200° C.).

According to an embodiment, the cyclic polyamine is represented by Structure II:

Structure II

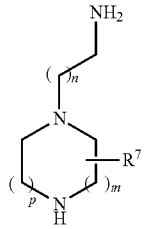

wherein $R^7$ is a hydrogen or a linear or branched-chain monovalent hydrocarbyl group having one to about twenty carbon atoms, m is from 0 to 4, p is from 0 to 4, wherein m+p is from 2 to 4, and n is from 1 to 6. $R^7$ may be cyclic or acylic. In some embodiments, $R^7$ is saturated. In other embodiments, $R^7$ is unsaturated. The cyclic polyamine serves as the source of basic tertiary amines.

Many of the polyamines suitable for use in the present invention are commercially available and others may be prepared by methods which are well known in the art. For example, methods for preparing amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99 116.

Suitable examples of cyclic polyamines include, for example, aminoethyl piperazine, aminopropyl piperazine, aminobutyl piperazine, aminoethyl diazepane, aminoethyl diazocane, suitable derivatives thereof, and the like.

One class of the reaction products may be represented by Structure III:

Structure III

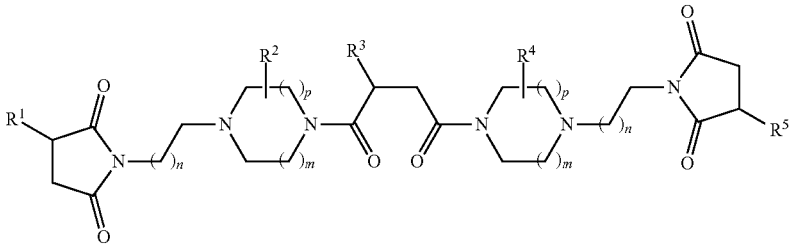

wherein each $R^1$ and $R^5$ is independently a linear or branched-chain monovalent hydrocarbyl group having one to about twenty carbon atoms, wherein each $R^2$, $R^3$, and $R^4$ is independently a hydrogen, a linear or branched-chain monovalent hydrocarbyl group having one to about twenty carbon atoms, each m is independently from 0 to 4, each p is independently from 0 to 4, for each cyclic moiety m+p is from 2 to 4, and each n is independently from 1 to 6.

Molybdenum Containing Compound

The molybdenum containing compound is an organomolybdenum compound comprising molybdenum, carbon and hydrogen atoms, but may also contain sulfur, phosphorus, nitrogen and/or oxygen atoms. Suitable organomolybdenum compounds include molybdenum dithiocarbamates, molybdenum dithiophosphates, and various organic molybdenum complexes such as molybdenum carboxylates, molybdenum esters, molybdenum amines, molybdenum amides, which can be obtained by reacting molybdenum oxide or ammonium molybdates with fats, glycerides or fatty acids, or fatty acid derivatives (e.g., esters, amines, amides). The term "fatty" means a carbon chain having 8 to 22 carbon atoms, typically a straight carbon chain.

Suitable molybdenum dithiocarbamates include any molybdenum dithiocarbamate which can be used as an additive for lubricating oils. One class of molybdenum dithiocarbamates for use herein is represented by Structure IV:

Structure IV

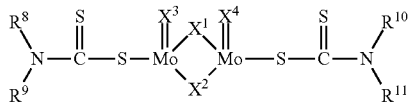

wherein $R^8$, $R^9$, $R^{10}$, and $R^{11}$ are each independently hydrogen or a hydrocarbon group including, by way of example, alkyl groups, alkenyl groups, aryl groups, cycloalkyl groups and cycloalkenyl groups, and $X^1$, $X^2$, $X^3$ and $X^4$ are each independently sulfur or oxygen. In some embodiments, each $R^8$, $R^9$, $R^{10}$, and $R^{11}$ independently comprise from 6 to 18 carbon atoms.

Suitable alkyl groups include, but are not limited to, methyl, ethyl, propyl, isopropyl, butyl, isobutyl, secondary butyl, tertiary butyl, pentyl, isopentyl, secondary pentyl, neopentyl, tertiary pentyl, hexyl, secondary hexyl, heptyl, secondary heptyl, octyl, 2-ethylhexyl, secondary octyl, nonyl, secondary nonyl, decyl, secondary decyl, undecyl, secondary undecyl, dodecyl, secondary dodecyl, tridecyl, isotridecyl, secondary tridecyl, tetradecyl, secondary tetradecyl, hexadecyl, secondary hexadecyl, stearyl, icosyl, docosyl, tetracosyl, triacontyl, 2-butyloctyl, 2-butyldecyl, 2-hexyloctyl, 2-hexyldecyl, 2-octyldecyl, 2-hexyldodecyl, 2-octyldodecyl, 2-decyltetradecyl, 2-dodecylhexadecyl, 2-hexadecyloctadecyl, 2-tetradecyloctadecyl, monomethyl branched-isostearyl and the like.

Suitable alkenyl groups include, but are not limited to, vinyl, allyl, propenyl, butenyl, isobutenyl, pentenyl, isopentenyl, hexenyl, heptenyl, octenyl, nonenyl, decenyl, undecenyl, dodecenyl, tetradecenyl, oleyl and the like.

Suitable aryl groups include, but are not limited to, phenyl, tolyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, biphenyl, benzylphenyl, styrenated phenyl, p-cumylphenyl, alpha-naphthyl, beta-naphthyl groups and the like.

Suitable cycloalkyl groups and cycloalkenyl groups include, but are not limited to, cyclopentyl, cyclohexyl, cycloheptyl, methylcyclopentyl, methylcyclohexyl, methylcycloheptyl, cyclopentenyl, cyclohexenyl, cycloheptenyl, methylcyclopentenyl, methylcyclohexenyl, methylcycloheptenyl groups and the like.

In Structure IV, $X^1$ to $X^4$ are independently selected from sulfur or oxygen atom, and all of $X^1$ to $X^4$ may be a sulfur atom or an oxygen atom, or a mixture of sulfur atoms and oxygen atoms. In consideration of balance between friction reducing effect and corrosivity, the molar ratio (ratio of numbers) of sulfur atom(s)/oxygen atom(s) should particularly preferably be in the range from about 1/3 to about 3/1.

Some of the oil-soluble or dispersed oil-stable molybdenum compounds of Structure IV are commercially available. For example, products where $X^1$ and $X^2$ are O, $X^3$ and $X^4$ are S, and where $R^8$ to $R^{11}$ are $C_{13}H_{27}$ aliphatic hydrocarbyl groups and where the molybdenum is in oxidation state V are sold under the trademarks Molyvan® 807 and Molyvan® 822 as antioxidants and friction reducing additives by R.T. Vanderbilt Company Inc. (Norwalk, Conn. USA). These molybdenum compounds may be prepared by the methods described in U.S. Pat. No. 3,356,702 wherein $MoO_3$ is converted to soluble molybdate by dissolving in alkali metal hydroxide solution, neutralized by the addition of acid followed by the addition of a secondary amine and carbon disulfide. In another aspect, the molybdenum compounds of Structure IV wherein $X^1$ to $X^4$ are O or S may be prepared by a number of methods known in the art such as, for example, U.S. Pat. Nos. 4,098,705 and 5,631,213.

Generally, the sulfurized oxymolybdenum dithiocarbamates represented by Structure IV can be prepared by reacting molybdenum trioxide or a molybdate with an alkali sulfide or an alkali hydrosulfide, and subsequently adding carbon disulfide and a secondary amine to the reaction mixture and reacting the resultant mixture at an adequate temperature. To prepare the asymmetric sulfurized oxymolybdenum dithiocarbamates, the use of a secondary amine having different hydrocarbon groups or the use of two or more different secondary amines in the above process is sufficient. The symmetric sulfurized oxymolybdenum dithiocarbamates can also be prepared in a similar manner, but with the use of only one secondary amine.

Examples of suitable molybdenum dithiocarbamate compounds include, but are not limited to, sulfurized molybdenum diethyldithiocarbamate, sulfurized molybdenum dipropyldithiocarbamate, sulfurized molybdenum dibutyldithiocarbamate, sulfurized molybdenum dipentyldithiocarbamate, sulfurized molybdenum dihexyldithiocarbamate, sulfurized molybdenumn dioctyldithiocarbamate, sulfurized molybdenum didecyldithiocarbamate, sulfurized molybdenum didodecyldithiocarbamate, sulfurized molybdenum ditridecyldithiocarbamate, sulfurized molybdenum di(butylphenyl)dithiocarbamate, sulfurized molybdenum di(nonylphenyl)dithiocarbamate, sulfurized oxymolybdenum diethyldithiocarbamate, sulfurized oxymolybdenum dipropyldithiocarbamate, sulfurized oxymolybdenum dibutyldithiocarbamate, sulfurized oxymolybdenum dipentyldithiocarbamate, sulfurized oxymolybdenum dihexyldithiocarbamate, sulfurized oxymolybdenum dioctyldithiocarbamate, sulfurized oxymolybdenum didecyldithiocarbamate, sulfurized oxymolybdenum didodecyldithiocarbamate, sulfurized oxymolybdenum ditridecyldithiocarbamate, sulfurized oxymolybdenum di(butylphenyl)dithiocarbamate, sulfurized oxymolybdenum di(nonylphenyl)dithiocarbamate, all of which the alkyl groups may be straight-chain or branched, and the like and mixtures thereof.

Trinuclear molybdenum dialkyldithiocarbamates are also known in the art, as taught by U.S. Pat. Nos. 5,888,945 and 6,010,987, herein incorporated by reference. Trinuclear molybdenum compounds preferably those having the formulas $Mo_3S_4(dtc)_4$ and $Mo_3S_7(dtc)_4$ and mixtures thereof wherein dtc represents independently selected diorganodithiocarbamate ligands containing independently selected organo groups and wherein the ligands have a sufficient number of carbon atoms among all the organo groups of the compound's ligands are present to render the compound soluble or dispersible in the lubricating oil.

Molybdate esters prepared by methods disclosed in U.S. Pat. Nos. 4,889,647 and 6,806,241 B2. A commercial example is MOLYVAN® 855 additive, which is manufactured by R. T. Vanderbilt Company, Inc.

Molybdenum dithiophosphate (MoDTP) is an organomolybdenum compound represented by the following Structure V:

Structure V

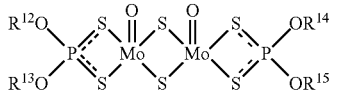

wherein $R^{12}$, $R^{13}$, $R^{14}$ and $R^{15}$ are independently of each other, linear or branched alkyl groups having from 4 to 18 carbon atoms (e.g., 8 to 13 carbon atoms).

Molybdenum carboxylates are described in U.S. Pat. RE 38,929, and U.S. Pat. No. 6,174,842 and thus are incorporated herein by reference. Molybdenum carboxylates can be derived from any oil soluble carboxylic acid. Typical carboxylic acids include naphthenic acid, 2-ethylhexanoic acid, and linolenic acid. Suitable examples of molybdenum compounds include commercial materials sold under the trade names such as Molyvan® 822, Molyvan® A, Molyvan® 2000. Molyvan® 807 and Molyvan® 855T from R. T. Vanderbilt Co., Ltd., and Sakura-Lube™ S-165, S-200, S-300, S-310G, S-525, S-600, S-700, and S-710 available from Adeka Corporation, and mixtures thereof. Suitable molybdenum components are described in U.S. Pat. No. 5,650,381; RE 37,363 E1; RE 38,929 E1; and RE 40,595 E1, incorporated herein by reference in their entireties Ammonium molybdates are prepared by the acid base reaction of acidic molybdenum source such as molybdenum trioxide, molybdic acid, and ammonium molybdate and ammonium thiomolybdates with oil-soluble amines and optionally in presence of sulfur sources such sulfur, inorganic sulfides and polysulfides, and carbons disulfide to name few. The preferred aminic compounds are polyamine dispersants that are commonly used engine oil compositions. Examples of such dispersants are succinimides and Mannich type. References to these preparations are U.S. Pat. Nos. 4,259,194, 4,259,195, 4,265,773, 4,265,843, 4,727,387, 4,283,295, and 4,285,822.

In one embodiment, the molybdenum amine is a molybdenum-succinimide complex. Suitable molybdenum-succinimide complexes are described, for example, in U.S. Pat. No. 8,076,275. These complexes are prepared by a process comprising reacting an acidic molybdenum compound with an alkyl or alkenyl succinimide of a polyamine of structure VI or VII or mixtures thereof:

Structure VI

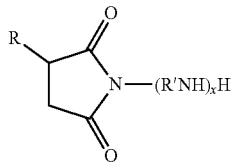

Structure VII

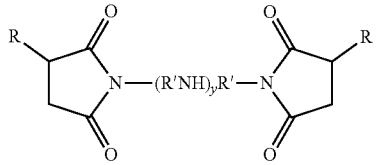

wherein R is a $C_{24}$ to $C_{350}$ (e.g., $C_{70}$ to $C_{128}$) alkyl or alkenyl group; R' is a straight or branched-chain alkylene group having 2 to 3 carbon atoms; x is 1 to 11; and y is 1 to 10.

The molybdenum compounds used to prepare the molybdenum-succinimide complex are acidic molybdenum compounds or salts of acidic molybdenum compounds. By "acidic" is meant that the molybdenum compounds will react with a basic nitrogen compound as measured by ASTM D664 or D2896. Generally, the acidic molybdenum compounds are hexavalent. Representative examples of suitable molybdenum compounds include molybdenum trioxide, molybdic acid, ammonium molybdate, sodium molybdate, potassium molybdate and other alkaline metal molybdates and other molybdenum salts such as hydrogen salts, (e.g., hydrogen sodium molybdate), $MoOCl_4$, $MoO_2Br_2$, $Mo_2O_3Cl_6$, and the like.

The succinimides that can be used to prepare the molybdenum-succinimide complex are disclosed in numerous references and are well known in the art. Certain fundamental types of succinimides and the related materials encompassed by the term of art "succinimide" are taught in U.S. Pat. Nos. 3,172,892; 3,219,666; and 3,272,746. The term "succinimide" is understood in the art to include many of the amide, imide, and amidine species which may also be formed. The predominant product however is a succinimide and this term has been generally accepted as meaning the product of a reaction of an alkyl or alkenyl substituted succinic acid or anhydride with a nitrogen-containing compound. Preferred succinimides are those prepared by reacting a polyisobutenyl succinic anhydride of about 70 to 128 carbon atoms with a polyalkylene polyamine selected from triethylenetetramine, tetraethylenepentamine, and mixtures thereof.

In one embodiment, the molybdenum containing compound is free of sulfur.

The molybdenum-succinimide complex may be post-treated with a sulfur source at a suitable pressure and a temperature not to exceed 120° C. to provide a sulfurized molybdenum-succinimide complex. The sulfurization step may be carried out for a period of from about 0.5 to 5 hours (e.g., 0.5 to 2 hours). Suitable sources of sulfur include elemental sulfur, hydrogen sulfide, phosphorus pentasulfide, organic polysulfides of formula $R_2S_x$ where R is hydrocarbyl (e.g., $C_1$ to $C_{10}$ alkyl) and x is at least 3, $C_1$ to $C_{10}$ mercaptans, inorganic sulfides and polysulfides, thioacetamide, and thiourea.

Lubricating Oil

When employed as lubricant additives, the tertiary amine-containing compound of the present invention is usually present in the lubricating oil composition in concentrations ranging from about 0.001 to about 20 wt. % (including, but not limited to, 0.01 to 5 wt. %, 0.2 to 4 wt. %, 0.5 to 3 wt. %, 1 to 2 wt. %, and so forth), based on the total weight of the lubricating oil composition.

When employed as lubricant additives, the molybdenum containing compound of the present invention is usually present in the lubricating oil composition in concentrations ranging from about 50 to about 1500 ppm (including, but not limited to, 200 to 1400 ppm, 250 to 1250 ppm, 500 to 1000 ppm, 500 to 750 ppm, and so forth).

Oils used as the base oil will be selected or blended depending on the desired end use and the additives in the finished oil to give the desired grade of engine oil, e.g. a lubricating oil composition having an Society of Automotive Engineers (SAE) Viscosity Grade of 0W, 0W-8, 0W-12, 0W-16, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, or 15W-40.

The oil of lubricating viscosity (sometimes referred to as "base stock" or "base oil") is the primary liquid constituent of a lubricant, into which additives and possibly other oils are blended, for example to produce a final lubricant (or lubricant composition). A base oil, which is useful for making concentrates as well as for making lubricating oil compositions therefrom, may be selected from natural (vegetable, animal or mineral) and synthetic lubricating oils and mixtures thereof.

Definitions for the base stocks and base oils in this disclosure are the same as those found in American Petroleum Institute (API) Publication 1509 Annex E ("API Base Oil Interchangeability Guidelines for Passenger Car Motor Oils and Diesel Engine Oils," December 2016). Group I base stocks contain less than 90% saturates and/or greater than 0.03% sulfur and have a viscosity index greater than or equal to 80 and less than 120 using the test methods specified in Table E-1. Group II base stocks contain greater than or equal to 90% saturates and less than or equal to 0.03% sulfur and have a viscosity index greater than or equal to 80 and less than 120 using the test methods specified in Table E-1. Group III base stocks contain greater than or equal to 90% saturates and less than or equal to 0.03% sulfur and have a viscosity index greater than or equal to 120 using the test methods specified in Table E-1. Group IV base stocks are polyalphaolefins (PAO). Group V base stocks include all other base stocks not included in Group I, II, III, or IV.

Natural oils include animal oils, vegetable oils (e.g., castor oil and lard oil), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Synthetic oils include hydrocarbon oil. Hydrocarbon oils include oils such as polymerized and interpolymerized olefins (e.g., polybutylenes, polypropylenes, propylene isobutylene copolymers, ethylene-olefin copolymers, and ethylene-alphaolefin copolymers). Polyalphaolefin (PAO) oil base stocks are commonly used synthetic hydrocarbon oil. By way of example, PAOs derived from $C_8$ to $C_{14}$ olefins, e.g., $C_8$, $C_{10}$, $C_{12}$, $C_{14}$ olefins or mixtures thereof, may be utilized.

Other useful fluids for use as base oils include non-conventional or unconventional base stocks that have been processed, preferably catalytically, or synthesized to provide high performance characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks. Other base oils include Coal to liquid (CTL) products and alkyl-naphthalene.

Base oils for use in the lubricating oil compositions of present disclosure are any of the variety of oils corresponding to API Group I, Group II, Group III, Group IV, and Group V oils, and mixtures thereof, preferably API Group II, Group III, Group IV, and Group V oils, and mixtures thereof, more preferably the Group III to Group V base oils due to their exceptional volatility, stability, viscometric and cleanliness features.

Typically, the base oil will have a kinematic viscosity at 100° C. (ASTM D445) in a range of 1.5 to 35 $mm^2/s$ (e.g., 1.5 to 25 $mm^2/s$, 2.0 to 20 $mm^2/s$, or 2.0 to 15 $mm^2/s$).

The present lubricating oil compositions may also contain conventional lubricant additives for imparting auxiliary functions to give a finished lubricating oil composition in which these additives are dispersed or dissolved. For example, the lubricating oil compositions can be blended with antioxidants, ashless dispersants, anti-wear agents, detergents such as metal detergents, rust inhibitors, dehazing agents, demulsifying agents, friction modifiers, metal deactivating agents, pour point depressants, viscosity modifiers, antifoaming agents, co-solvents, package compatibilizers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Each of the foregoing additives, when used, is used at a functionally effective amount to impart the desired properties to the lubricant. Thus, for example, if an additive is an ashless dispersant, a functionally effective amount of this ashless dispersant would be an amount sufficient to impart the desired dispersancy characteristics to the lubricant. Generally, the concentration of each of these additives, when used, may range, unless otherwise specified, from about 0.001 to about 20 wt. %, such as about 0.01 to about 10 wt. %.

The following non-limiting examples are illustrative of the present invention. Brief descriptions of how the examples were prepared are provided.

EXAMPLES

Comparative Example A

Comparative Example A is a baseline 0W-16 lubricating oil containing 14.1 wt % total of succinimide dispersant, calcium detergent, secondary ZnDTP, phenolic antioxidant, foam inhibitor, and polymethacrylate-based viscosity modifier. Comparative Example A also contains 700 ppm molybdenum from MoDTC.

Comparative Example B

Comparative Example B includes the baseline 0W-16 lubricating oil of Comparative Example A and 0.3 wt % of glycerol monooleate.

Comparative Example C

Comparative Example C includes the lubricating oil of Comparative Example A, 0.3 wt % of glycerol monooleate, and 700 ppm of molybdenum from MoDTC.

Comparative Example D

Comparative Example D includes the baseline 0W-16 lubricating oil of Comparative Example A, 0.3 wt % of a C16/18 1,2-hydroxyalkane friction modifier, and 700 ppm molybdenum from MoDTC.

Comparative Example E

Comparative Example E includes the baseline 0W-16 lubricating oil of Comparative Example A, 0.3 wt % of an alkyl diamine friction modifier, and 700 ppm molybdenum from MoDTC.

Comparative Example F

Comparative Example F includes the baseline 0W-16 lubricating oil of Comparative Example A, and 0.3 wt % of the reaction product of branched C18 succinic anhydride and aminoethyl piperazine. The charge mole ratio (CMR) of the succinic anhydride to aminoethyl piperazine is 1.6:1.

Example 1

Example 1 includes the baseline 0W-16 lubricating oil of Comparative Example A, 0.3 wt % of the reaction product of branched $C_{18}$ succinic anhydride and aminoethyl piperazine (charge mole ratio of the succinic anhydride to aminoethyl piperazine is 1.6:1), and 700 ppm of molybdenum from MoDTC.

Example 2

Example 2 includes the baseline 0W-16 lubricating oil of Comparative Example A, 0.1 wt % of the reaction product of branched $C_{18}$ succinic anhydride and aminoethyl piperazine (CMR succinic anhydride to aminoethyl piperazine is 1.6:1), and 700 ppm molybdenum from MoDTC.

Example 3

Example 3 includes the baseline 0W-16 lubricating oil of Comparative Example A, 1.0 wt % of the reaction product of branched $C_{18}$ succinic anhydride and aminoethyl piperazine (CMR succinic anhydride to aminoethyl piperazine is 1.6:1), and 700 ppm molybdenum from MoDTC.

MTM Friction Test

Mini Traction Machine (MTM) was employed to evaluate friction performance. MTM is a ball-on-disc type tribomachine which can measure friction properties of lubricants under a wide range of sliding-rolling conditions by controlling sliding and rolling speeds separately. The test specimens are a 19.05 mm diameter ball and a 46 mm diameter disc which are made of 52100 steel with hardness 720-780 VPN.

All friction coefficient were measured after two hours of rubbing at an entrainment speed of 100 mm/s, temperature at 60° C., load 37 N (a maximum Hertzian contact pressure 1.02 GPa) and SRR (slide-roll ratio) 50%.

After rubbing for 2 hours, coefficient of friction measurements were taken with an applied load of 37N and SRR (slide-roll ratio) 50%, with entrainment speed for Stribeck measurements starting from 3000 mm/s decreasing down to 2 mm/s, consisting of 36 data points. The results are shown in Table 1.

The final boundary friction result was provided according to cumulative area calculated between entrainment speed 2 and 10 mm/s using the following formula:

$$\text{Boundary Friction}=\Sigma((\text{CoFi}+\text{CoFi}+1)/2)\times(\text{Log}(\text{Entrainment speed } i+1)-\text{Log}(\text{Entrainment speed } i))$$

TABLE 1

| | Ex. 1 | Ex. 2 | Ex. 3 | Comp Ex. A | Comp Ex. B | Comp Ex. C | Comp Ex. D | Comp Ex. E | Comp Ex. F |
|---|---|---|---|---|---|---|---|---|---|
| Tertiary amine FM (wt %) | 0.3 | 0.1 | 1.0 | 0 | 0 | 0 | 0 | 0 | 0.3 |
| Moly from MoDTC (ppm) | 700 | 700 | 700 | 700 | 0 | 700 | 700 | 700 | 0 |
| Boundary Friction (Speed 2-10) | 0.027 | 0.031 | 0.031 | 0.037 | 0.073 | 0.060 | 0.062 | 0.046 | 0.084 |
| Friction change (%) vs Comp Ex. A | −28 | −17 | −18 | 0 | 97 | 61 | 67 | 23 | 127 |

All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

Likewise, the term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

The terms "a" and "the" as used herein are understood to encompass the plural as well as the singular.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

The foregoing description of the disclosure illustrates and describes the present disclosure. Additionally, the disclosure shows and describes only the preferred embodiments but, as mentioned above, it is to be understood that the disclosure is capable of use in various other combinations, modifications, and environments and is capable of changes or modifications within the scope of the concept as expressed herein, commensurate with the above teachings and/or the skill or knowledge of the relevant art. While the foregoing is directed to embodiments of the present disclosure, other and further embodiments of the disclosure may be devised without departing from the basic scope thereof, and the scope thereof is determined by the claims that follow.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein.

The embodiments described hereinabove are further intended to explain best modes known of practicing it and to enable others skilled in the art to utilize the disclosure in such, or other, embodiments and with the various modifications required by the particular applications or uses. Accordingly, the description is not intended to limit it to the form disclosed herein. Also, it is intended that the appended claims be construed to include alternative embodiments.

The invention claimed is:

1. A lubricating oil composition comprising:

a) major amount of a base oil; and b) minor amount of a synergistic friction modifier composition comprising:

i) a molybdenum containing compound; and ii) a tertiary amine-containing compound having the following structure:

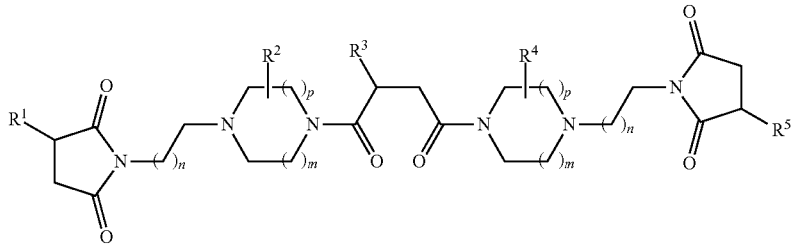

wherein each $R^1$ and $R^5$ is independently a linear or branched-chain monovalent hydrocarbyl group having one to about twenty carbon atoms, wherein each $R^2$, $R^3$, and $R^4$ is independently a hydrogen, a linear or branched-chain monovalent hydrocarbyl group having one to about twenty carbon atoms, each m is independently from 0 to 4, each p is independently from 0 to 4, for each cyclic moiety m+p is from 2 to 4, and each n is independently from 1 to 6.

2. The lubricating oil composition of claim 1, wherein the linear or branched-chain monovalent hydrocarbyl group is a branched $C_{12}$ to $C_{20}$ alkenyl group.

3. The lubricating oil composition of claim 1, wherein the linear or branched-chain monovalent hydrocarbyl group is a branched $C_{18}$ to $C_{20}$ alkenyl group.

4. The lubricating oil composition of claim 1, wherein the tertiary amine-containing additive is present in about 0.1 to 2 wt % by weight of the lubricating oil composition.

5. The lubricating oil composition of claim 1, wherein the molybdenum containing compound is a molybdenum dithiocarbamate, molybdenum dithiophosphate, molybdenum carboxylate, molybdenum ester, molybdenum amine, or molybdenum amide.

6. The lubricating oil composition of claim 5, wherein the molybdenum dithiocarbamate is given by the following structure:

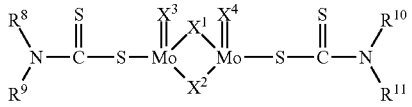

wherein $R^8$, $R^9$, $R^{10}$, and $R^{11}$ are each independently hydrogen or a hydrocarbon group including, by way of example, alkyl groups, alkenyl groups, aryl groups, cycloalkyl groups and cycloalkenyl groups, and $X^1$, $X^2$, $X^3$ and $X^4$ are each independently sulfur or oxygen.

7. The lubricating oil composition of claim 1, wherein the molybdenum containing compound is present in the lubricating oil composition in concentration ranging from about 50 to about 1500 ppm.

8. A method of modifying friction comprising lubricating an engine with a lubricating oil comprising:

a) major amount of base oil; and b) minor amount of a synergistic friction modifier composition comprising:

i) a molybdenum containing compound; and ii) a tertiary amine-containing additive having the following structure:

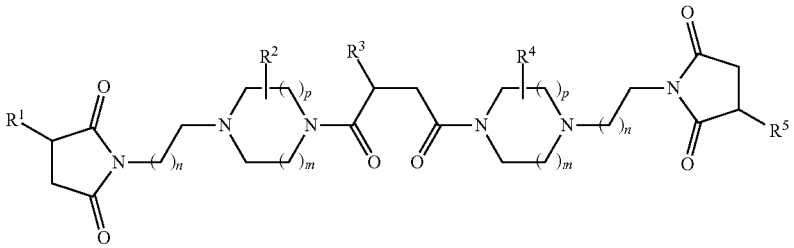

wherein each $R^1$ and $R^5$ is independently a linear or branched-chain monovalent hydrocarbyl group having one to about twenty carbon atoms, wherein each $R^2$, $R^3$, and $R^4$ is independently a hydrogen, a linear or branched-chain monovalent hydrocarbyl group having one to about twenty carbon atoms, each m is independently from 0 to 4, each p is independently from 0 to 4, for each cyclic moiety m+p is from 2 to 4, and each n is independently from 1 to 6.

9. The method of claim 8, wherein the linear or branched-chain monovalent hydrocarbyl group is a branched $C_{12}$ to $C_{20}$ alkenyl group.

10. The method of claim 8, wherein the linear or branched-chain monovalent hydrocarbyl group is a branched $C_{18}$ to $C_{20}$ alkenyl group.

11. The method of claim 8, wherein the tertiary amine-containing additive is present in about 0.1 to 2 wt % by weight of the lubricating oil composition.

12. The method of claim 8, wherein the molybdenum containing compound is a molybdenum dithiocarbamate, molybdenum dithiophosphate, molybdenum carboxylate, molybdenum ester, molybdenum amine, or molybdenum amide.

13. The method of claim 12, wherein the molybdenum dithiocarbamate is given by the following structure:

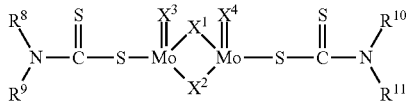

wherein $R^8$, $R^9$, $R^{10}$, and $R^{11}$ are each independently hydrogen or a hydrocarbon group including, by way of example, alkyl groups, alkenyl groups, aryl groups, cycloalkyl groups and cycloalkenyl groups, and $X^1$, $X^2$, $X^3$ and $X^4$ are each independently sulfur or oxygen.

14. The method of claim 8, wherein the molybdenum containing compound is present in the lubricating oil composition in concentration ranging from about 50 to about 1500 ppm.

15. A lubricating oil composition comprising:

a) major amount of a base oil;

b) a molybdenum containing compound; and c) a product of a reaction comprising:

i) a hydrocarbyl-substituted succinic anhydride represented by the following structure:

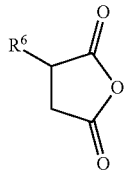

wherein $R^6$ is a linear or branched-chain monovalent hydrocarbyl group having one to about twenty carbon atoms; and ii) a cyclic polyamine represented by the following structure:

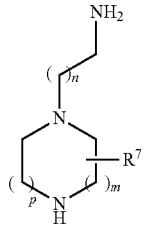

wherein $R^7$ is hydrogen or a linear or branched-chain monovalent hydrocarbyl group having one to about twenty carbon atoms, m is from 0 to 4, p is from 0 to 4, m+p is from 2 to 4, and n is from 1 to 6; and wherein the hydrocarbyl-substituted succinic anhydride to cyclic polyamine ratio is from about 1.5:1 to about 1.6:1.

16. The lubricating oil composition of claim 15, wherein the cyclic amine is aminoethyl piperazine, aminopropyl piperazine, aminobutyl piperazine, aminoethyl diazepane, or aminoethyl diazocane.

17. The lubricating oil composition of claim 15, wherein the molybdenum containing compound is a molybdenum dithiocarbamate, molybdenum dithiophosphate, molybdenum carboxylate, molybdenum ester, molybdenum amine, or molybdenum amide.

18. The lubricating oil composition of claim 17, wherein the molybdenum dithiocarbamate is given by the following structure:

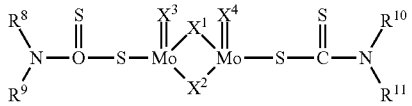

wherein $R^8$, $R^9$, $R^{10}$, and $R^{11}$ are each independently hydrogen or a hydrocarbon group including, by way of example, alkyl groups, alkenyl groups, aryl groups, cycloalkyl groups and cycloalkenyl groups, and $X^1$, $X^2$, $X^3$ and $X^4$ are each independently sulfur or oxygen.

19. The lubricating oil composition of claim 15, wherein the molybdenum containing compound is present in the lubricating oil composition in concentration ranging from about 50 to about 1500 ppm.

20. The lubricating oil composition of claim 18, wherein each $R^8$, $R^9$, $R^{10}$ and $R^{11}$ independently comprise 6 to 18 carbon atoms.

* * * * *